US011766119B2

(12) United States Patent
Netzer et al.

(10) Patent No.: US 11,766,119 B2
(45) Date of Patent: Sep. 26, 2023

(54) LOCKING DEVICE FOR RELEASABLY LOCKING A WITHDRAWABLE FURNITURE PART

(71) Applicant: Julius Blum GmbH, Hoechst (AT)

(72) Inventors: Emanuel Netzer, Hoechst (AT); Daniel Wohlgenannt, Bregenz (AT)

(73) Assignee: Julius Blum GmbH, Hoechst (AT)

( * ) Notice: Subject to any disclaimer, the term of this patent is extended or adjusted under 35 U.S.C. 154(b) by 20 days.

(21) Appl. No.: 17/376,802

(22) Filed: Jul. 15, 2021

(65) Prior Publication Data

US 2021/0337965 A1 Nov. 4, 2021

Related U.S. Application Data

(63) Continuation of application No. PCT/AT2019/060415, filed on Dec. 5, 2019.

(30) Foreign Application Priority Data

Jan. 29, 2019 (AT) ..... A 50071/2019

(51) Int. Cl.
*A47B 88/45* (2017.01)
*A47B 88/427* (2017.01)
(Continued)

(52) U.S. Cl.
CPC ..... *A47B 88/45* (2017.01); *A47B 88/427* (2017.01); *A47B 88/46* (2017.01); *A47B 88/53* (2017.01); *A47B 2210/0078* (2013.01)

(58) Field of Classification Search
CPC ..... A47B 88/45; A47B 88/46; A47B 88/53; A47B 88/427; A47B 2210/0078
See application file for complete search history.

(56) References Cited

U.S. PATENT DOCUMENTS 2,630,364 A * 3/1953 Gleason ..... H05K 7/16 312/333
2,730,423 A * 1/1956 Mock ..... A47B 88/57 312/334.22
(Continued)

FOREIGN PATENT DOCUMENTS

CN 103338680 10/2013
CN 103648332 3/2014
(Continued)

OTHER PUBLICATIONS

International Search Report dated Feb. 7, 2020 in International (PCT) Application No. PCT/AT2019/060415
(Continued)

*Primary Examiner* — James O Hansen
(74) *Attorney, Agent, or Firm* — Wenderoth, Lind & Ponack, L.L.P.

(57) ABSTRACT

An arrangement includes a drawer pull-out guide and a locking device for releasably locking a furniture part. The drawer pull-out guide includes a carcass rail to be fixed to a furniture carcass and an extension rail, the extension rail being displaceably supported between a fully closed position and a fully open position. The locking device includes a first locking component to be fixed to the furniture carcass, and a second locking component to be fixed to the extendably-supported furniture part. The first locking component and the second locking component can be releasably locked together, and the second locking component includes a base member and a locking element for releasably locking the first locking component. The locking element is pivotally supported on the base member, and the extension rail of the drawer pull-out guide can be releasably locked by the locking device in or immediately before the fully open position.

17 Claims, 7 Drawing Sheets

(51) Int. Cl.
*A47B 88/46* (2017.01)
*A47B 88/53* (2017.01)

(56) References Cited

U.S. PATENT DOCUMENTS

| | | | | |
|---|---|---|---|---|
| 3,782,800 | A * | 1/1974 | Remington | A47B 88/57 312/334.47 |
| 5,203,620 | A | 4/1993 | McLennan | |
| 6,682,158 | B2 * | 1/2004 | Lai | A47B 88/57 312/334.46 |
| 6,955,380 | B1 | 10/2005 | Barr | |
| 7,261,329 | B1 | 8/2007 | Julian et al. | |
| 8,041,175 | B2 * | 10/2011 | Krampotich | G02B 6/4453 70/85 |
| 8,439,459 | B2 * | 5/2013 | Johnson | E05B 65/46 312/334.44 |
| 8,950,833 | B2 | 2/2015 | Bohle | |
| 9,820,573 | B2 | 11/2017 | Brunnmayr | |
| 10,206,503 | B2 | 2/2019 | Stuffel et al. | |
| 10,575,637 | B2 | 3/2020 | Wohlgenannt | |
| 2008/0036345 | A1 * | 2/2008 | Kropf | E05B 65/46 312/333 |
| 2010/0327719 | A1 | 12/2010 | Koenig et al. | |
| 2012/0038255 | A1 * | 2/2012 | Netzer | A47B 88/463 312/319.1 |
| 2013/0307390 | A1 | 11/2013 | Bohle | |
| 2014/0060991 | A1 * | 3/2014 | Bohle | A47B 88/40 192/56.1 |
| 2014/0210329 | A1 | 7/2014 | Brunnmayr | |
| 2017/0020285 | A1 | 1/2017 | Schallert et al. | |
| 2018/0153304 | A1 | 6/2018 | Stuffel et al. | |
| 2018/0160807 | A1 | 6/2018 | Wohlgenannt | |
| 2018/0263369 | A1 * | 9/2018 | Chen | A47B 88/437 |

FOREIGN PATENT DOCUMENTS

| | | |
|---|---|---|
| CN | 107849885 | 3/2018 |
| DE | 94 18 689.8 | 5/1995 |
| DE | 202 06 522 | 9/2002 |
| DE | 20 2006 015 529 | 1/2007 |
| EP | 2 153 749 | 2/2010 |
| EP | 3 199 062 | 8/2017 |
| GB | 2 226 946 | 7/1990 |
| JP | 2014-530688 | 11/2014 |
| JP | 2017-511189 | 4/2017 |
| WO | 2009/114887 | 9/2009 |

OTHER PUBLICATIONS

Search Report dated May 31, 2022 in corresponding Chinese Patent Application No. 201980090413.4

* cited by examiner

LOCKING DEVICE FOR RELEASABLY LOCKING A WITHDRAWABLE FURNITURE PART

BACKGROUND OF THE INVENTION

The present invention relates to an arrangement comprising at least one drawer pull-out guide and at least one locking device for releasably locking a furniture part, in particular an extendable work surface, extendably-supported on a furniture carcass in at least one position relative to the furniture carcass. The drawer pull-out guide includes a carcass rail configured to be fixed to a furniture carcass and at least one extension rail, and the extension rail is displaceably supported relative to the carcass rail between a fully closed position and a fully open position.

Locking devices having a pivotally supported locking element for locking a drawer are disclosed in U.S. Pat. No. 6,955,380 B1, DE 20 2006 015 529 U1, DE 202 06 522 U1, U.S. Pat. No. 5,203,620, EP 3 199 062 A1 and WO 2009/114887 A1 for example.

By a locking device of this kind, an extendable furniture part, in particular an extendable work surface such as a shelf board or an extendable shelf panel, can be locked in a fully open position relative to a furniture carcass. In this way, an inadvertent return movement of the movable furniture part into the furniture carcass can be prevented. This is, for example, useful when the movable furniture part is configured for the extendable support of kitchen machines (coffee machine, kitchen mixer), for supporting multimedia devices (screen, computer keyboard), as an extendable writing board or as a diaper changing table. When the extendable work surface is no longer used, the locking is released, whereby the movable furniture part can be moved into the furniture carcass and can be received in a space-saving manner therein.

Such locking devices usually include two locking components configured to be locked to one another. A first locking component is to be fixed to the furniture carcass, and a second locking component is to be fixed to the movable furniture part. The locking components are frequently produced as a one-piece component made of plastic, and the locking components engage into one another in a locked position. By applying a force to the movable furniture part, the locking between the locking components can be again released, after a predetermined holding force has been overcome. This holding force must be overcome by a user for each unlocking operation. Moreover, the unlocking operation frequently produces an unpleasant noise.

SUMMARY OF THE INVENTION

It is an object of the present invention to propose a locking device of the type mentioned in the introductory part, thereby avoiding the above-discussed drawbacks.

According to the invention, the locking device includes a first locking component configured to be fixed to the furniture carcass, and at least one second locking component configured to be fixed to the extendably-supported furniture part, the first locking component and the second locking component being configured to be releasably locked to one another. At least the second locking component includes a base member and a locking element for releasably locking the first locking component, the locking element being pivotally supported about a pivoting axis on the base member, and the extension rail of the drawer pull-out guide can be releasably locked by the locking device in the fully open position or in a position immediately before reaching the fully open position.

In a locked condition of the extension rail, a movement of the extension rail in a direction of the closed position can be prevented.

By the pivotally supported locking element, the holding force and/or the frictional resistance for releasing the locking between the two locking components can be reduced, because the locking element is movable by a manual movement about the pivoting axis into a release position in which the locking components can be released.

A further advantage of the invention lies in the fact that the locking element pivotable about the pivoting axis can be simply connected to a pivotable actuating lever, and the locking element can be locked and/or can be unlocked by a pivoting movement of the actuating lever.

Eventually, a further advantage of the invention lies in the fact that a pivoting movement of the locking element of the locking device can be synchronized with a pivoting movement of a second locking element of a second locking device via a synchronization device. The first locking device is arranged on a first side of the movable furniture part, whereas the second locking device is arranged on a second side, opposing the first side, of the movable furniture part. By the synchronization device, a pivoting movement of the two locking elements can be synchronized with one another. This provides, for example, the possibility that the locking operation and/or the unlocking operation of the extendable furniture part can be performed with the left hand, or, alternatively, with the right hand.

According to an embodiment, the locking element for locking the two locking components can be automatically locked by a force of a force storage member. Alternatively, it is possible that the locking of the two locking components can be established by a movement of the locking element deliberately performed by a person.

BRIEF DESCRIPTION OF THE DRAWINGS

Further details and advantages of the present invention result from the following description of figures.

DETAILED DESCRIPTION OF THE INVENTION

Figure 1A:
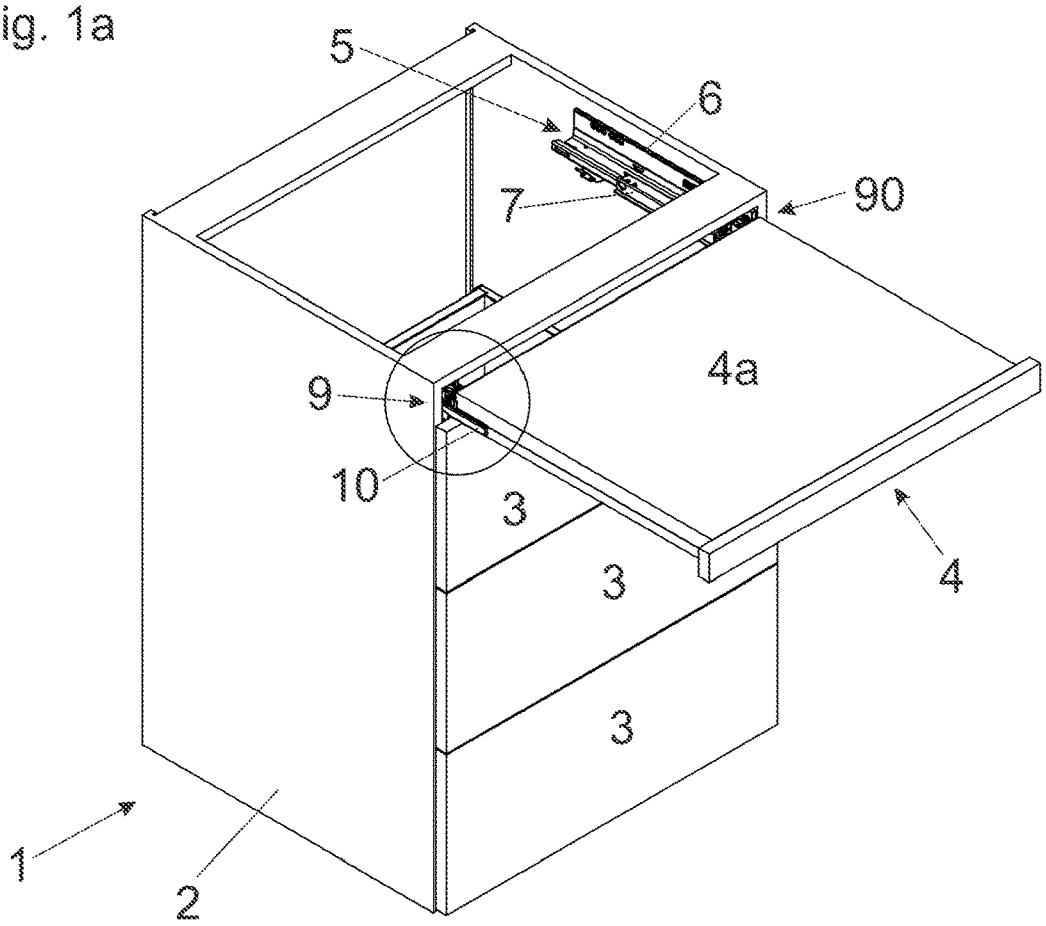
FIG. 1*a*, 1*b* show an item of furniture comprising a furniture part extendable relative to a furniture carcass in a perspective view and in an enlarged detail view.

FIG. 1*a* shows a perspective view of an item of furniture 1 comprising a furniture carcass 2 and drawers 3 displaceably supported relative to the furniture carcass 2. Above the drawers 3, an extendably-supported furniture part 4 in the form of a work surface 4*a* is arranged, the work surface 4*a* being displaceably supported relative to the furniture carcass 2 between a fully closed and a fully open position. By a locking device 9, the extendable furniture part 4 can be releasably locked in the fully open position or in a position immediately before reaching the fully open position. In this way, an inadvertent closing movement of the extendable furniture part 4 in a direction of the closed position can be prevented. This is, for example, advantageous when the extendable furniture part 4 is provided for supporting kitchen machines, for supporting multimedia devices, as a diaper changing table or as an extendable writing board. For movably supporting the furniture part 4, opposing drawer pull-out guides 5 are provided. The pull-out guides 5 include a carcass rail 6 configured to be fixed to the furniture carcass 2 and at least one extension rail 8 (FIG. 2) displaceably supported relative to the carcass rail 6. For realizing a full-extension, a displaceable central rail 7 may be provided between the carcass rail 6 and the extension rail 8.

The extendable furniture part 4 is automatically lockable by the locking device 9 in the fully open position or in a position immediately before reaching the fully open position. The locking device 9 includes at least one actuating lever 10 for releasing the locking of the extendable furniture part 4. In the shown embodiment, the actuating lever 10 is pivotally supported about a horizontally extending pivoting axis (X) in a mounted position. The locking of the furniture part 4 can be released by manually lifting a free end of the actuating lever 10. In the shown figure, the actuating lever 10 is arranged laterally outwardly beside the extendable furniture part 4, so that the actuating lever 10 is immediately and directly accessible for a person in the open position of the furniture part 4.

According to a preferred embodiment, a locking device 9 is arranged on a first side of the extendable furniture part 4, and a further locking device 90 is arranged on a second side, opposing the first side, of the furniture part 4. It is preferable that the locking device 9 and the further locking device 90 are identical in construction. In this way, the locking of the furniture part 4 can be released by a person with the left hand or, alternatively, with the right hand. In this connection, it can be advantageous when a pivoting movement of the two opposing actuating levers 10 can be transmitted via a synchronization device 15 (FIG. 3), so that an unlocking of one locking device 9 also leads to an unlocking of the other locking device 90 via the synchronization device 15. For example, the synchronization device 15 can be implemented by a cable-pulling device or by a synchronization rod 15*a*, the synchronization rod 15*a* extending between the first side and the second side of the furniture part 4 and being configured to synchronize a pivoting movement of the two actuating levers 10 to one another.

Figure 1B:
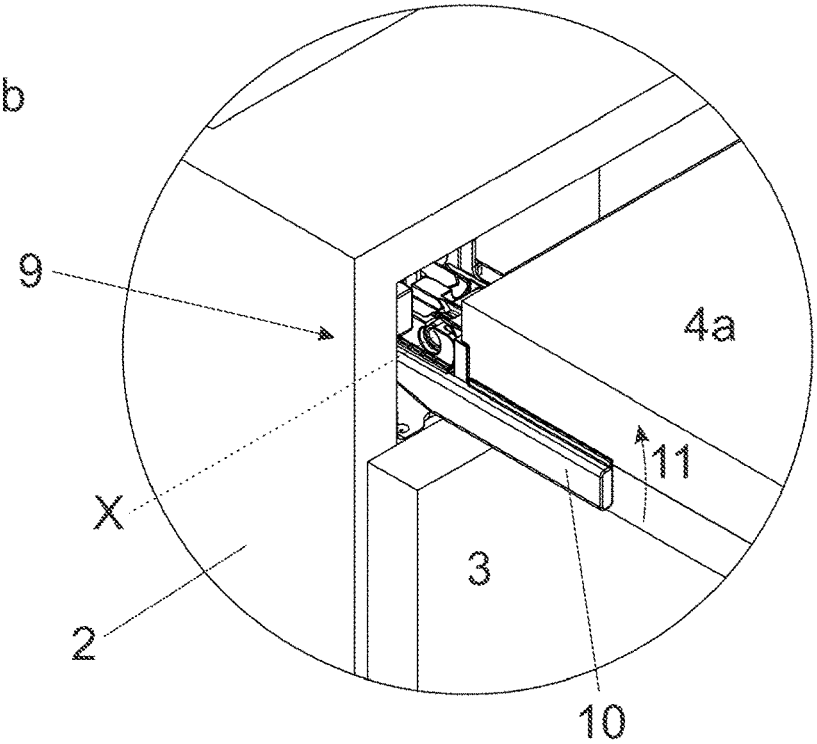

FIG. 1*b* shows the encircled region of FIG. 1*a* in an enlarged view. The actuating lever 10 is pivotally arranged about a horizontally extending pivoting axis (X) on the rear-end region of the extendable furniture part 4. In the locked position, the actuating lever 10 is releasably locked to a first locking component 16 (FIG. 2) arranged on the furniture carcass 2 or on the carcass rail 6 of the drawer pull-out guide 5. The actuating lever 10 is configured to be unlocked by a movement in a direction of the depicted arrow 11.

Figure 2:
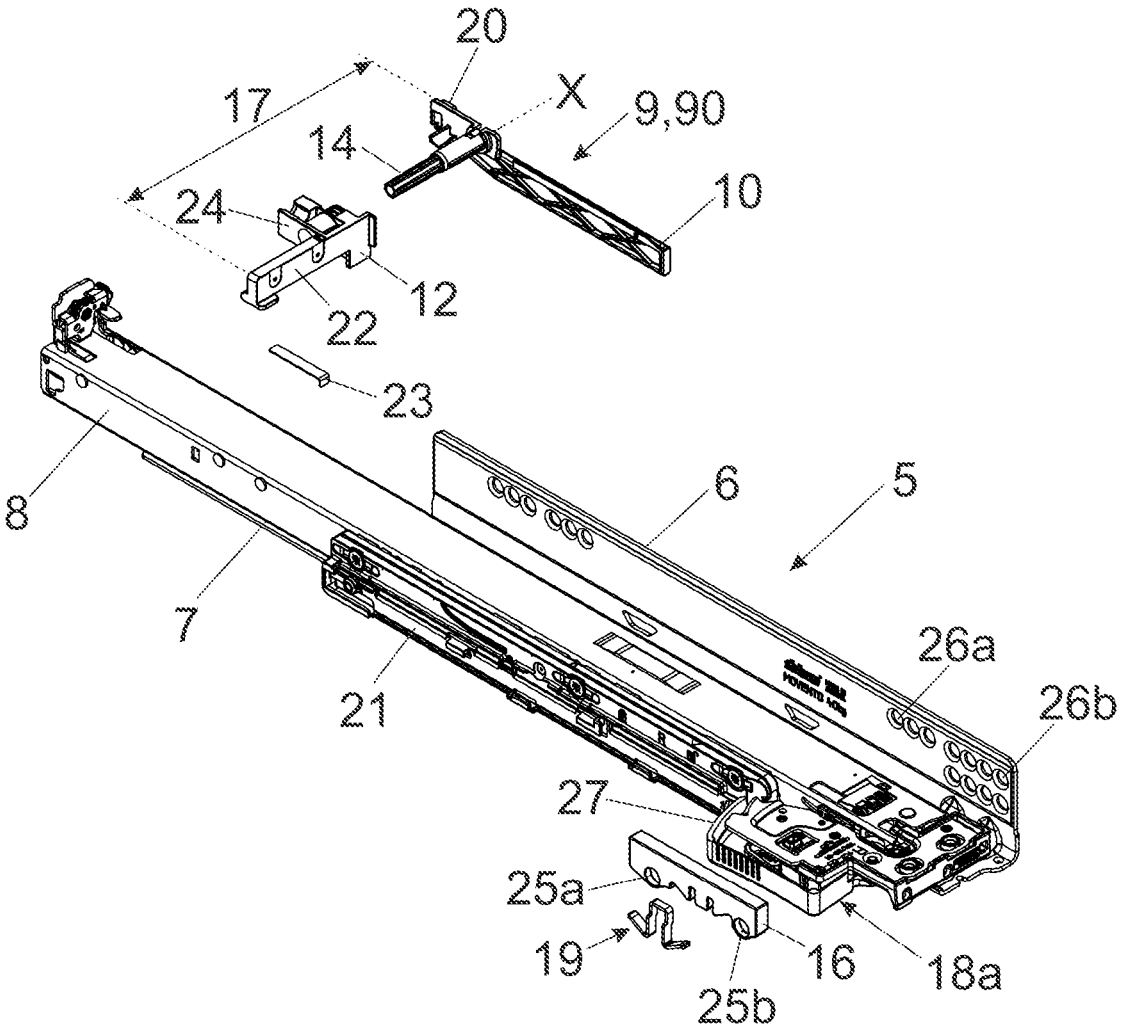
FIG. 2 shows a drawer pull-out guide with a locking device in a perspective view.

FIG. 2 shows the drawer pull-out guide 5 with the locking device 9, 90 in a perspective view. The locking devices 9, 90 can be configured so as to be identical. Therefore, the following explanations apply to both locking devices 9, 90.

The drawer pull-out guide 5 includes a carcass rail 6 configured to be fixed to the furniture carcass 2, and at least one extension rail 8 configured to be fixed to the extendable furniture part 4. The carcass rail 6 and the extension rail 8 are displaceably supported relative to one another. Optionally, a displaceable central rail 7 may be arranged between the carcass rail 6 and the extension rail 8. By a coupling device 18*a* which is known according to the prior art and which is to be fixed to the front-end of the extendable furniture part 4, the furniture part 4 can be releasably connected to the extension rail 8. The coupling device 18*a* includes a movable release portion 27 for releasing the connection between the extendable furniture part 4 and the extension rail 8. By a spring-assisted retraction device 21, the extension rail 8 can be retracted into the closed end position at the end of the closing movement, and the retraction movement of the extension rail 8 can be dampened by a damper of the retraction device 21.

The locking device 9, 90 includes a first locking component 16 which is either to be fixed to the furniture carcass 2 or to the drawer pull-out guide 5, preferably to the carcass rail 6. For this purpose, the first locking component 16 includes at least one fastening device 25*a*, 25*b*. In the shown embodiment, the at least one fastening device 25*a*, 25*b* includes through holes for the passage of screws. The carcass rail 6 usually has openings 26*a*, 26*b* which are aligned flush with the through holes of the fastening devices 25*a*, 25*b*. By one and the same fasteners, preferably screws, the first locking component 16 can be fixed to the front-end of the carcass rail 6, and, at once, the carcass rail 6 can also be fixed to the furniture carcass 2. The first locking component 16 includes a force storage member 19 for releasably locking a locking element 20. It can be preferably provided that the force storage member 19 is formed by a spring clip made of metal, whereby the required forces for locking and/or unlocking of the locking element 20 can be advantageously dimensioned.

Figure 3:
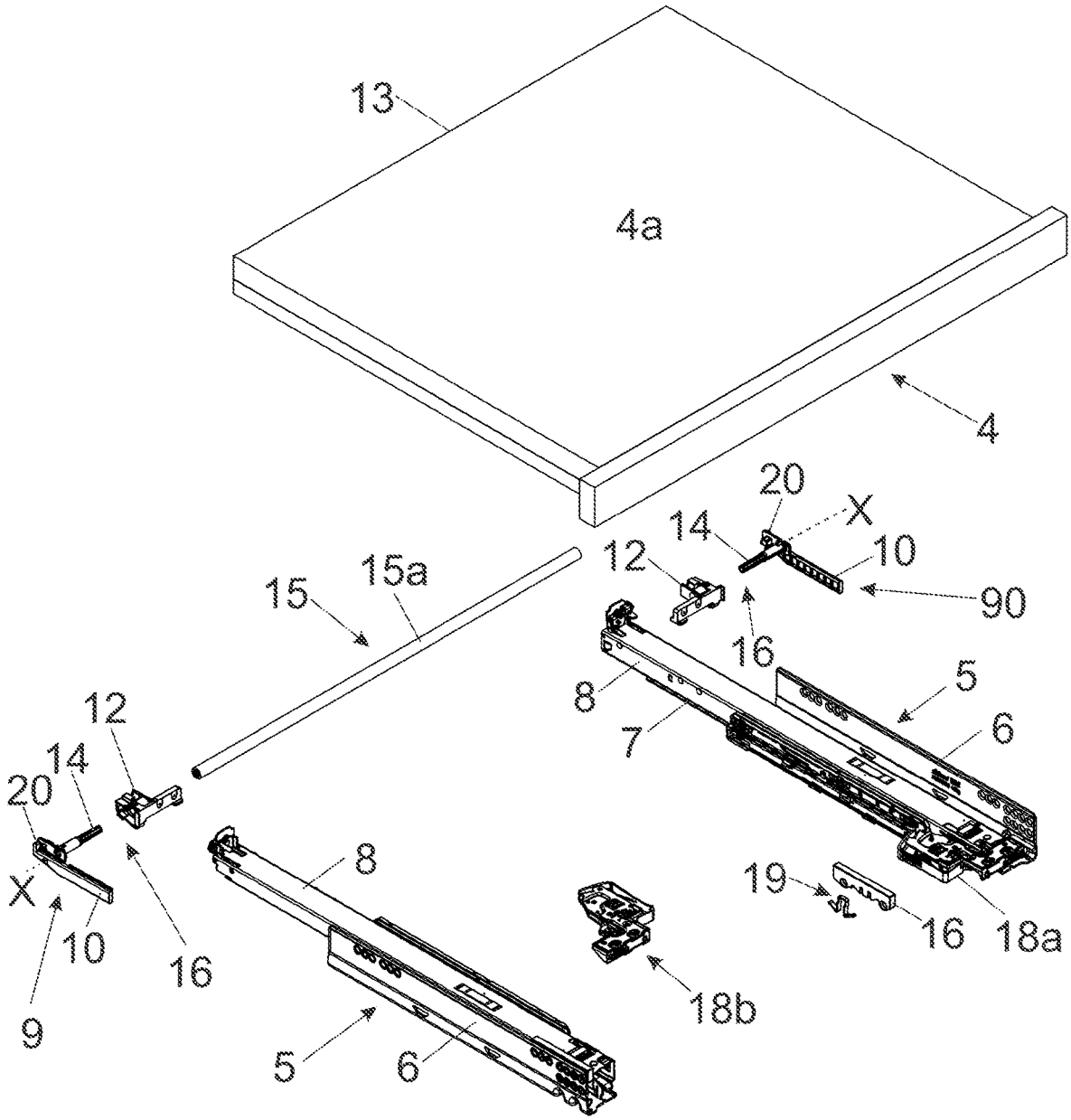
FIG. 3 is an exploded view of the extendable furniture part with the drawer pull-out guides and with the locking devices for releasably locking the extendable furniture part.

A second locking component 17 is to be fixed to the extendable furniture part 4. The second locking component 17 includes a base member 12 configured to be fixed to the furniture part 4, and the locking element 20 pivotally supported about a pivoting axis (X) on the base member 12. The base member 12 is provided with a fastening interface 22 for mounting the base member 12 to the extendable furniture part 4, preferably to the rear side 13 (FIG. 3). Moreover, the base member 12 includes a bearing 24 having a hollow-cylindrical portion for pivotally supporting the actuating lever 10. The actuating lever 10 is connected to the locking element 20 in a movement-coupled manner, and the actuating lever 10, jointly with the locking element 20, is pivotable about the pivoting axis (X). By a spring element 23, the actuating lever 10 can be pressurized in a direction of the locking position. By a pivotally supported coupling portion 14, a pivoting movement of the actuating lever 10 can be transmitted to a synchronization rod 15*a* (FIG. 3). The coupling portion 14 can have a non-circular cross-section for transmitting a pivoting movement in a form-locking manner. The coupling portion 14 can be arranged coaxially to the pivoting axis (X). Alternatively, it is possible that the coupling portion 14 is pivotally supported about an axis spaced in a parallel relationship from the pivoting axis (X).

FIG. 3 shows an exploded view of the extendable furniture part 4 in the form of the work surface 4*a* with two drawer pull-out guides 5 which are to be fixed to the furniture carcass 2. The drawer pull-out guides 5 are to be fixed to opposing sides of the furniture carcass 2, and the extendable furniture part 4 can be releasably connected to the opposing extension rails 8 via the coupling devices 18*a*, 18*b*. By a synchronization device 15, a pivoting movement of the actuating lever 10 on a first side of the furniture part 4*a* can be synchronized with a pivoting movement of the other actuating lever 10 on the second side of the furniture part 4. The synchronization device 15 can include, for example, a synchronization rod 15*a* configured to be pivotable about the pivoting axis (X), and the synchronization rod 15*a* is configured to be connected to the two coupling portions 14 in a form-locking manner.

Figure 4A:
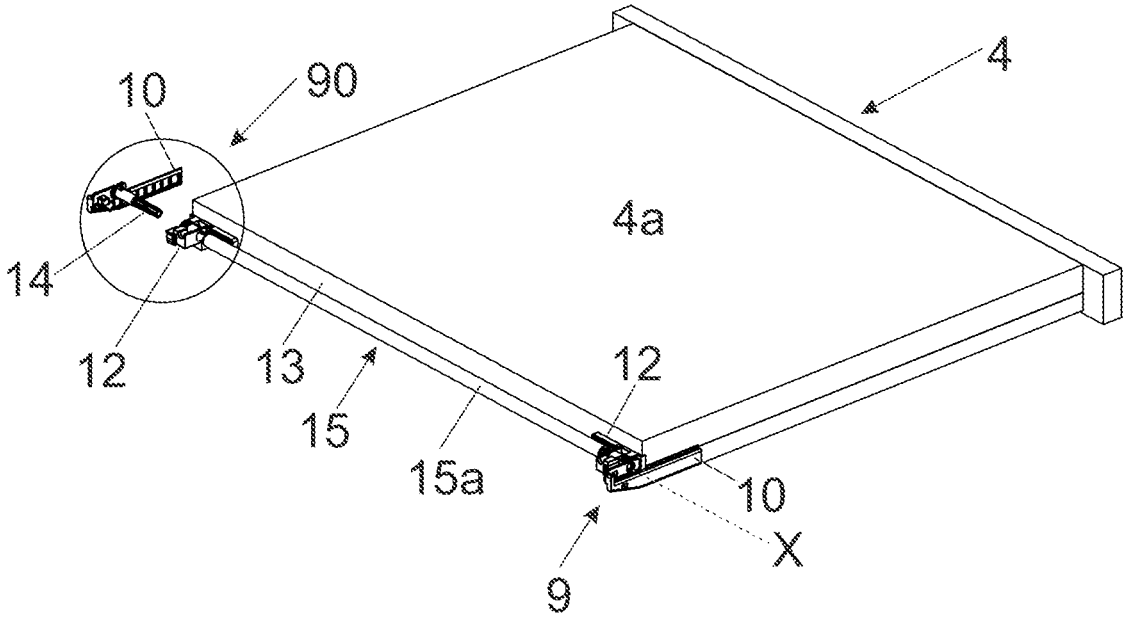
FIG. 4*a*, 4*b* show the extendable furniture part with the locking devices in a perspective view and an enlarged detail view thereof.

FIG. 4*a* shows the mounting operation of the locking devices 9, 90 and of the synchronization rod 15*a*. In a first mounting step, the base members 12 are to be mounted, via their fastening interface 22, to the rear side 13 of the extendable furniture part 4. In a subsequent step, the synchronization rod 15*a* is aligned approximately parallel to the pivoting axis (X). Subsequently, the coupling portions 14 are pushed onto the two end portions of the synchronization rod 15*a*, whereby a force-transmitting connection between the locking elements 20 and the synchronization rod 15*a* can be established.

Figure 4B:
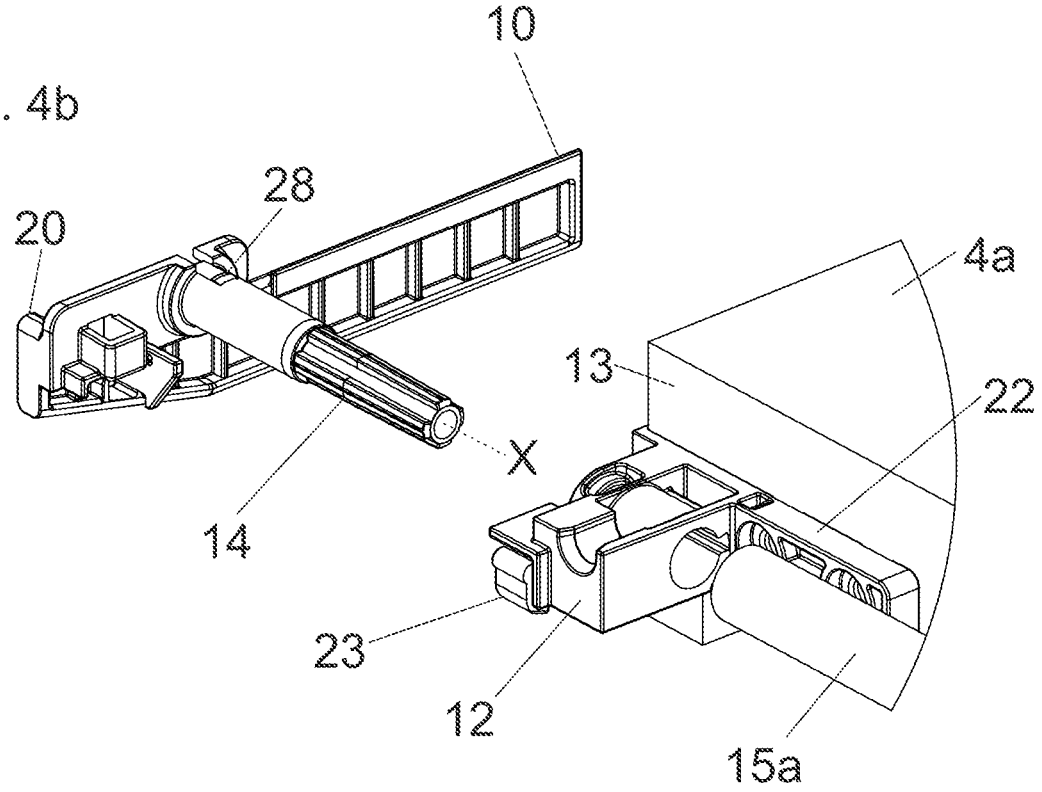

FIG. 4*b* shows the encircled region of FIG. 4*a* in an enlarged view. The connection between the coupling portion 14 and the base member 12 and/or the synchronization rod 15*a* can be secured by at least one latching nose 28. In the shown embodiment, the latching nose 28 is arranged on the coupling portion 14 and is configured co-operate with the base member 12 in the connected condition, preferably with the spring element 23 of the base member 12. Here, the spring element 23 and the base member 12 are formed together to have an integral one-piece configuration made of plastic. By applying a force to the spring element 23 against a resilient action of the spring element 23, the latching nose 28 can be unlocked, so that the actuating lever 10 can be again demounted. By the spring element 23, the actuating lever 10 (and therewith the locking element 20) can also be pressurized in a direction of the locking position.

Figure 5A:
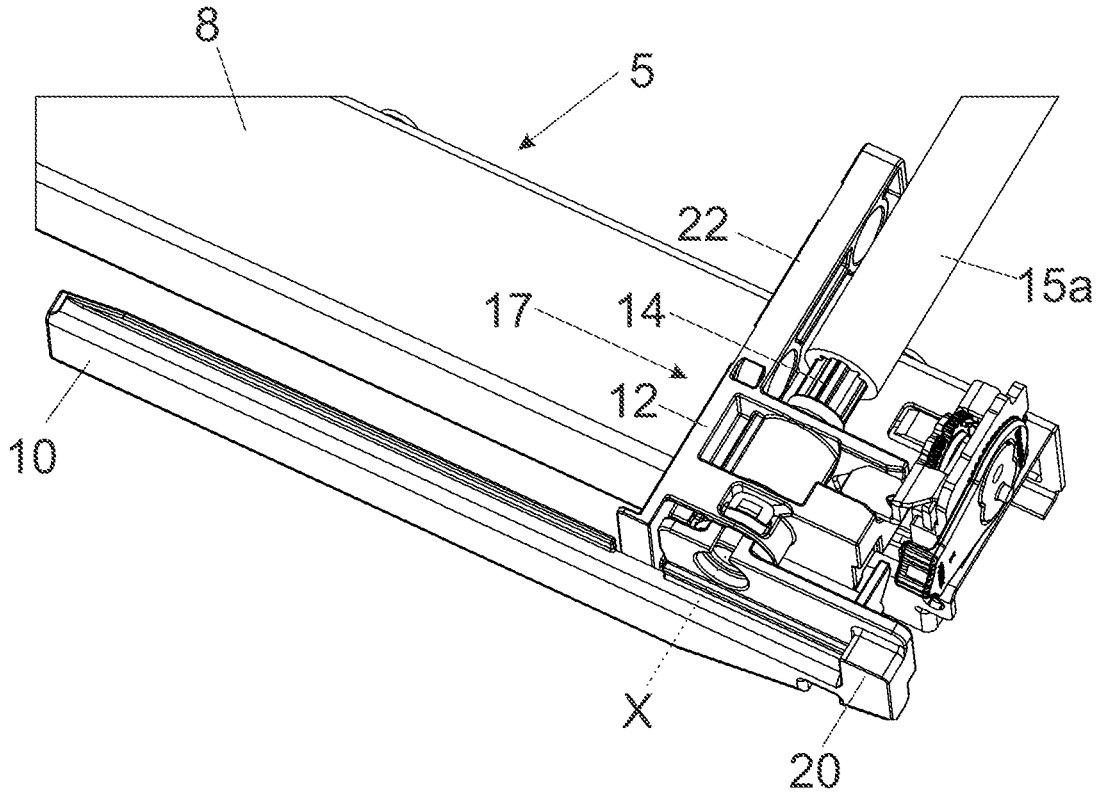
FIG. 5*a*, 5*b* are perspective views of the rear-end region and of the front-end region of the drawer pull-out guide.

FIG. 5*a* shows the rear-end region of the drawer pull-out guide 5 in a top view, in which the extendable furniture part 4 is hidden. The locking element 20, jointly with the actuating lever 10, is pivotally supported about the pivoting axis (X). The base member 12 of the second locking component 17 includes the fastening interface 22 configured to be fixed to the extendable furniture part 4. Instead of the depicted through holes, the fastening interface 22 can also include a dowel or a releasable tensioning device for fixing to the furniture part 4. The coupling portion 14 is configured to engage into an end portion of the synchronization rod 15*a*, and is configured to transmit, via the synchronization rod 15*a*, a pivoting movement of the actuating lever 10 about the pivoting axis (X) to the opposing side of the furniture part 4.

Figure 5B:
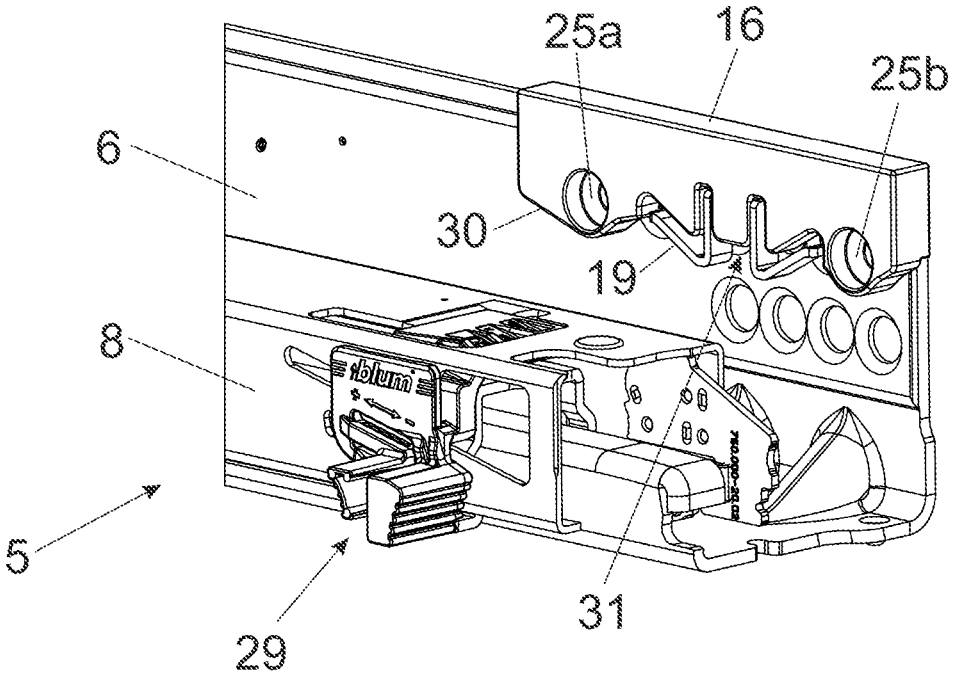

FIG. 5*b* shows the front-end region of the drawer pull-out guide 5, and the first locking component 16 is fixed to the carcass rail 6 via the fastening devices 25*a*, 25*b*. The fixing can be performed by screws which both fix the first locking component 16 to the carcass rail 6 and also the carcass rail 6 to the furniture carcass 2. The first locking component 16 includes at least one lead-in chamfer 30 for guiding the locking element 20. When the extendable furniture part 4 is moved relative to the furniture carcass 2 into the open position, the locking element 20 can be moved along the lead-in chamfer 30. A further lead-in chamfer is formed by the force storage member 19, and the locking element 20 is received within a locking recess 31 of the first locking component 16 in a locked position. The locking recess 31 can be formed by the force storage member 19, and the force storage member 19 can be configured as a form spring or as a spring clip. By a height adjustment device 29 supported on the extension rail 8, the front-end portion of the extendable furniture part 4 can be elevated or lowered relative to the extension rail 8.

Figure 6A:
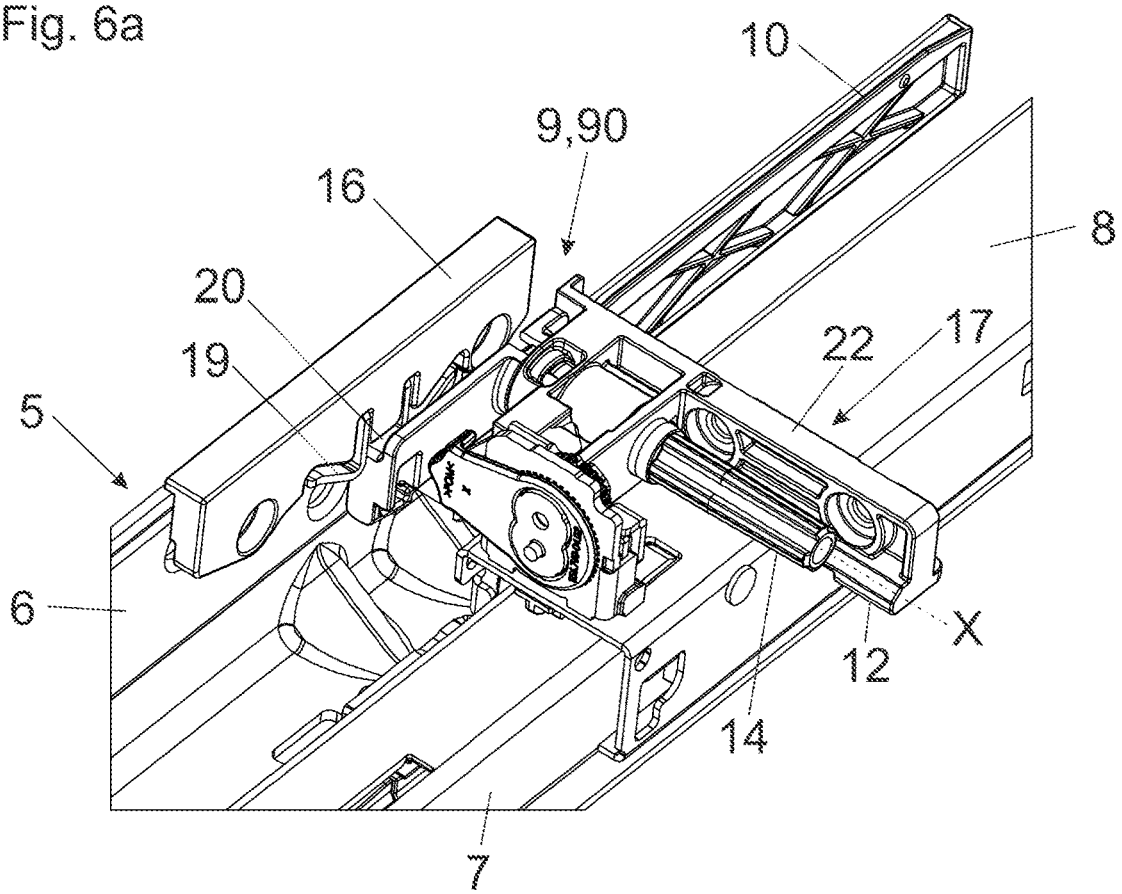
FIG. 6*a*, 6*b* are perspective views of the drawer pull-out guide in a locked condition of the first and second locking component, and the demounting operation of the extendable furniture part from the drawer pull-out guide.

FIG. 6*a* shows a perspective view of the drawer pull-out guide 5, in which the extendable furniture part 4 is hidden and the extension rail 8 is locked by the locking device 9, 90 in the fully open position or in a position immediately preceding the fully open position. It can be seen that the locking element 20 is received within the locking recess 31 of the first locking component 16 in the locked position.

Figure 6B:
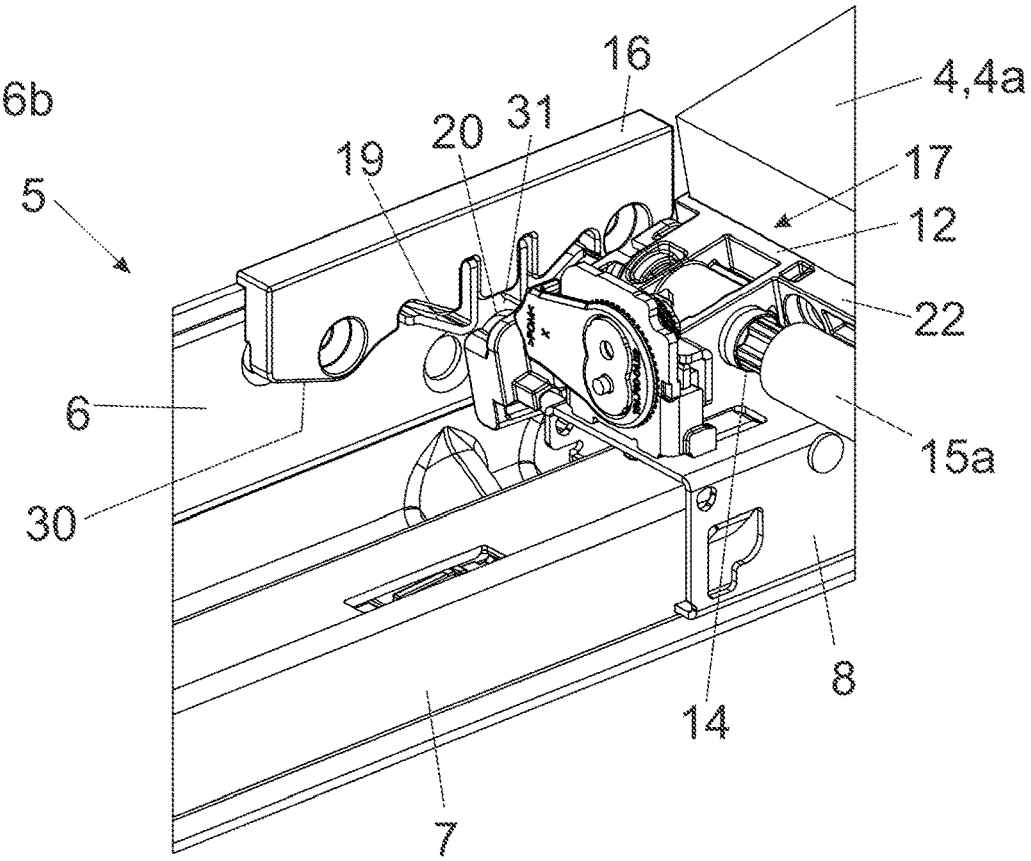
Figure 7A:
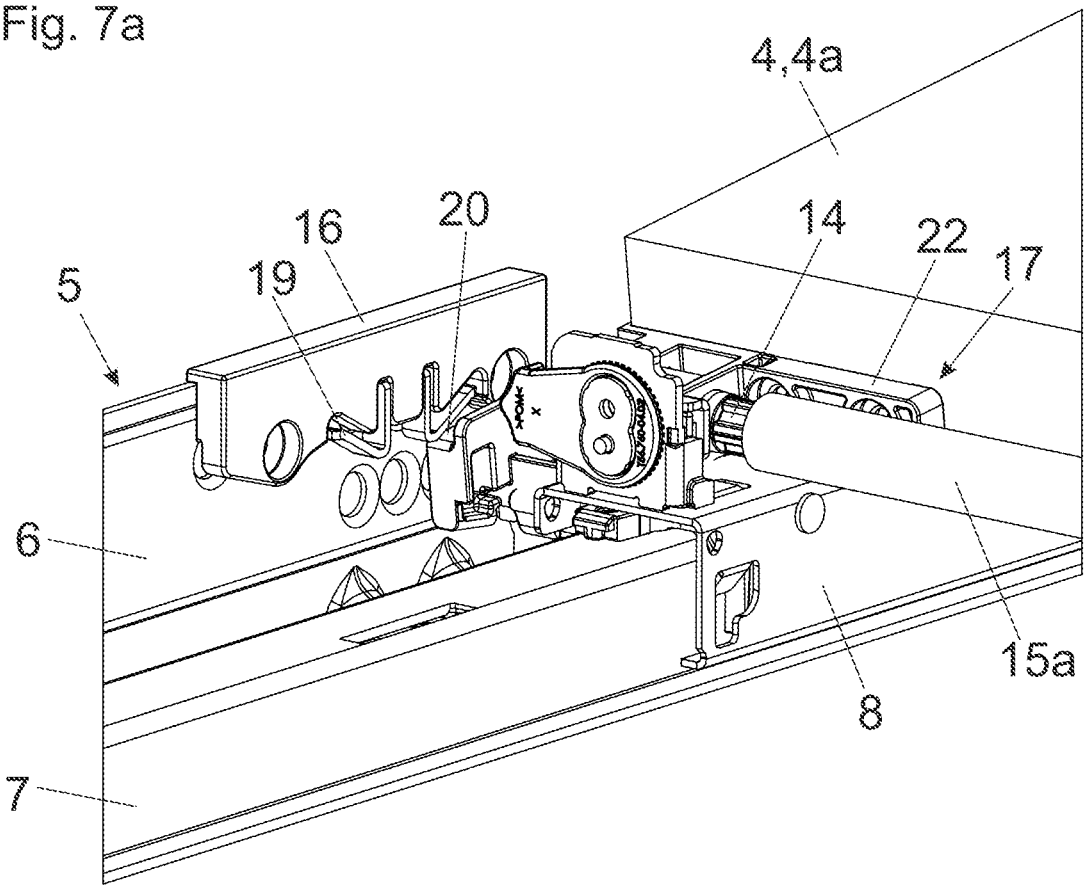
FIG. 7*a*, 7*b* show the demounting operation of the extendable furniture part from the drawer pull-out guide in two different views.

The reason why the extension rail 8 is not releasably lockable by the locking device 9, 90 in the fully open position, but rather in a position immediately preceding the fully closed position is due to the demounting operation of the extendable furniture part 4. Starting from the locked position according to FIG. 6*a*, the extendable furniture part 4 is demounted from the drawer pull-out guide 5 such that firstly the two actuating levers 10 are actuated. As a result, the locking elements 20 are moved out from their associated locking recesses 31 of the first locking components 16, as shown in FIG. 6*b*. Subsequently, the furniture part 4 is pulled out over a short distance (for example between 1 cm and 3 cm) further in the opening direction, as shown in FIG. 7*a*. Subsequently, the coupling devices 18*a*, 18*b* shown in FIG. 2 are decoupled from the extension rail 8 of the drawer pull-out guide 5, so that the extendable furniture part 4 can be separated from the drawer pull-out guide 5.

Figure 7B:
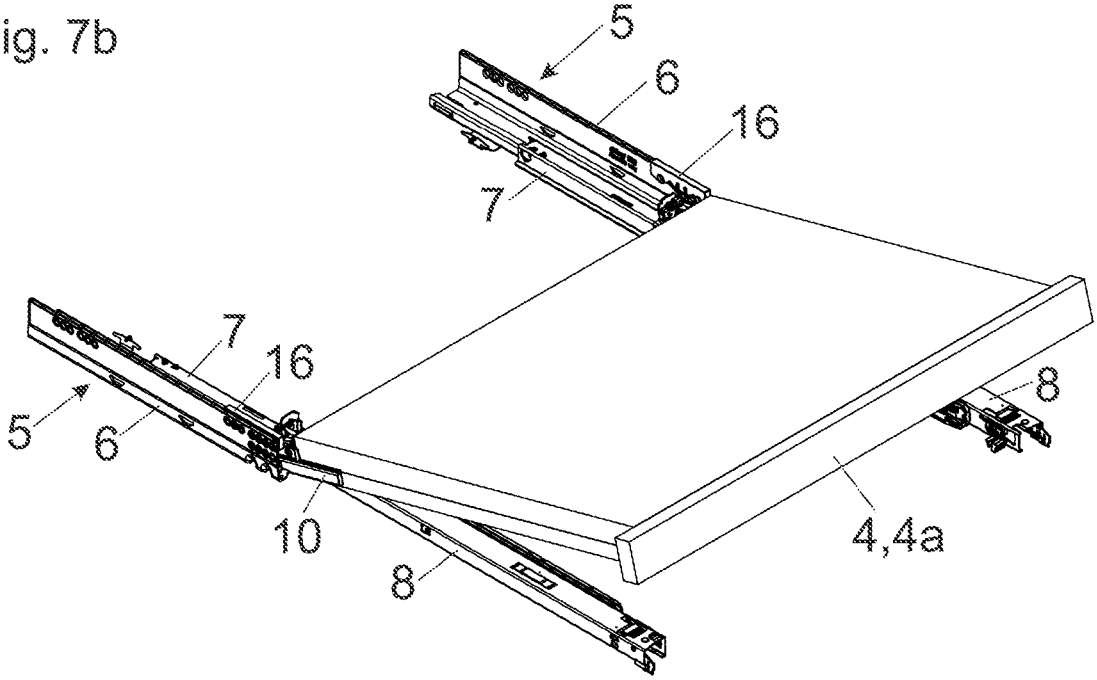

FIG. 7*b* shows a perspective view of the opposing drawer pull-out guides 5, after the coupling devices 18*a*, 18*b* shown in FIG. 2 have been decoupled from the extension rails 8 and the extendable furniture part 4 in the form of the work surface 4*a* achieves an inclined position in relation to the drawer pull-out guides 5 and can be demounted from the extension rails 8.

The described locking device 9, 90 can be mounted in a set both in the factory and directly on the spot by a client, namely as a constructional unit to be retro-fitted to already-existing drawer pull-out guides 5.

In contrast to the shown figures, the locking element 20 pivotable about the pivoting axis (X) with the actuating lever 10 can be supported, in a kinematic reversal, on the first locking component 16 to be fixed to the furniture carcass 2 or to the carcass rail 6. In a locked position, the locking element 20 can engage in a locking recess 31 arranged on the second locking component 17.

The invention claimed is:

1. An arrangement comprising:

a drawer pull-out guide; and a locking device for releasably locking a furniture part extendably-supported on a furniture carcass in at least one position relative to the furniture carcass, wherein the drawer pull-out guide includes a carcass rail configured to be fixed to the furniture carcass and an extension rail, the extension rail being displaceably supported relative to the carcass rail between a fully closed position and a fully open position, wherein the locking device includes a first locking component configured to be fixed to the furniture carcass, and a second locking component configured to be fixed to the extendably-supported furniture part, the first locking component and the second locking component being configured to be releasably locked to one another, wherein the second locking component includes a base member and a locking element for releasably locking the second locking component to the first locking component, the locking element being pivotally supported about a pivoting axis on the base member, and the extension rail of the drawer pull-out guide is releasably lockable by the locking device in the fully open position or in a position immediately before reaching the fully open position so as to prevent movement of the extension rail in a closing direction, and wherein the first locking component includes a force storage member for releasably locking the locking element.

2. The arrangement according to claim 1, wherein the second locking component includes a coupling portion for receiving a synchronization rod, and the coupling portion is connected to the locking element in a movement-coupled manner.

3. The arrangement according to claim 2, wherein the coupling portion includes a non-circular cross-section for transmitting a pivoting movement in a form-locking manner.

4. The arrangement according to claim 3, wherein the coupling portion is coaxially arranged to the pivoting axis of the locking element.

5. The arrangement according to claim 1, wherein the second locking component includes an actuating lever for unlocking the first locking component and the second locking component, and the actuating lever is connected to the locking element in a movement-coupled manner.

6. The arrangement according to claim 1, wherein the locking element is configured to engage into a locking recess of the first locking component in a locked condition between the first locking component and the second locking component.

7. The arrangement according to claim 1, wherein the base member of the second locking component includes a fastening interface for fastening the second locking component to the extendable furniture part.

8. The arrangement according to claim 1, wherein the second locking component includes a spring element for pre-stressing the locking element in a direction of a locking position.

9. The arrangement according to claim 1, wherein the first locking component includes a fastening device for fastening the first locking component to the furniture carcass.

10. The arrangement according to claim 9, wherein the fastening device is configured to be fixed to the carcass rail of the drawer pull-out guide.

11. The arrangement according to claim 1, wherein the first locking component includes a lead-in chamfer for displaceably guiding the locking element.

12. The arrangement according to claim 1, wherein the locking device is a first locking device, the arrangement further comprising a second locking device, wherein the first locking device is to be arranged on a first side of the extendable furniture part and the second locking device is to be arranged on a second side of the extendable furniture part opposing the first side.

13. The arrangement according to claim 12, further comprising a synchronization device including a synchronization rod, the synchronization rod being configured to be connected to pivotable locking elements of the first locking device and the second locking device in a movement-coupled manner.

14. The arrangement according to claim 12, wherein the locking element of the first locking device and a locking element of the second locking device are configured to be connected to one another in a movement-coupled manner via a synchronization device.

15. An arrangement comprising:

a drawer pull-out guide;

a first locking device for releasably locking a furniture part extendably-supported on a furniture carcass in at least one position relative to the furniture carcass;

a second locking device, wherein the first locking device is to be arranged on a first side of the extendably-supported furniture part and the second locking device is to be arranged on a second side of the extendably-supported furniture part opposing the first side; and a synchronization device including a synchronization rod, the synchronization rod being configured to be connected to pivotable locking elements of the first locking device and the second locking device in a movement-coupled manner, wherein the drawer pull-out guide includes a carcass rail configured to be fixed to the furniture carcass and an extension rail, the extension rail being displaceably supported relative to the carcass rail between a fully closed position and a fully open position, wherein the first locking device includes a first locking component configured to be fixed to the furniture carcass, and a second locking component configured to be fixed to the extendably-supported furniture part, the first locking component and the second locking component being configured to be releasably locked to one another, wherein the second locking component includes a base member and a first one of the pivotable locking elements for releasably locking the second locking component to the first locking component, the first one of the pivotable locking elements being pivotally supported about a pivoting axis on the base member, and the extension rail of the drawer pull-out guide is releasably lockable by the first locking device in the fully open position or in a position immediately before reaching the fully open position so as to prevent movement of the extension rail in a closing direction.

16. An arrangement comprising:

a drawer pull-out guide; and a locking device for releasably locking a furniture part extendably-supported on a furniture carcass in at least one position relative to the furniture carcass, wherein the drawer pull-out guide includes a carcass rail configured to be fixed to the furniture carcass and an extension rail, the extension rail being displaceably supported relative to the carcass rail between a fully closed position and a fully open position, wherein the locking device includes a first locking component configured to be fixed to the furniture carcass, and a second locking component configured to be fixed to the extendably-supported furniture part, the first locking component and the second locking component being configured to be releasably locked to one another, wherein the second locking component includes a base member and a locking element for releasably locking the second locking component to the first locking component, the locking element being pivotally supported about a pivoting axis on the base member, and the extension rail of the drawer pull-out guide is releasably lockable by the locking device in the fully open position or in a position immediately before reaching the fully open position so as to prevent movement of the extension rail in a closing direction, wherein the second locking component includes a coupling portion for receiving a synchronization rod, and the coupling portion is connected to the locking element in a movement-coupled manner, wherein the coupling portion includes a non-circular cross-section for transmitting a pivoting movement in a form-locking manner, and is coaxially arranged to the pivoting axis of the locking element.

17. An arrangement comprising:

a drawer pull-out guide;

a first locking device for releasably locking a furniture part extendably-supported on a furniture carcass in at least one position relative to the furniture carcass; and a second locking device, wherein the first locking device is to be arranged on a first side of the extendably-supported furniture part and the second locking device is to be arranged on a second side of the extendably-supported furniture part opposing the first side, wherein the drawer pull-out guide includes a carcass rail configured to be fixed to the furniture carcass and an extension rail, the extension rail being displaceably supported relative to the carcass rail between a fully closed position and a fully open position, wherein each of the first locking device and the second locking device includes a first locking component configured to be fixed to the furniture carcass, and a second locking component configured to be fixed to the extendably-supported furniture part, the first locking component and the second locking component being configured to be releasably locked to one another, wherein the second locking component includes a base member and a locking element for releasably locking the second locking component to the first locking component, the locking element being pivotally supported about a pivoting axis on the base member, and the extension rail of the drawer pull-out guide is releasably lockable by the locking device in the fully open position or in a position immediately before reaching the fully open position so as to prevent movement of the extension rail in a closing direction, and wherein the locking element of the first locking device and a locking element of the second locking device are configured to be connected to one another in a movement-coupled manner via a synchronization device.

* * * * *